US005112068A

United States Patent [19]

Liao et al.

[11] Patent Number: 5,112,068

[45] Date of Patent: May 12, 1992

[54] CONVERTIBLE GOLF CART AND BAG

[76] Inventors: Henry H. Liao; Meishin A. Liao, both of 3091 Quail Run Rd., Los Alamitos, Calif. 90720

[21] Appl. No.: 631,107

[22] Filed: Dec. 19, 1990

[51] Int. Cl.[5] ..... B62B 1/04

[52] U.S. Cl. ..... 280/30; 206/315.3; 280/47.26; 280/DIG. 6

[58] Field of Search ..... 280/DIG. 6, 47.26, 37, 280/47.131, 30; 190/18 A; 206/315.3

[56] References Cited

U.S. PATENT DOCUMENTS

| | | | |
|---|---|---|---|
| 2,405,674 | 8/1946 | Schuwa et al. | 280/DIG. 6 |
| 2,621,799 | 12/1952 | Wilson | 280/DIG. 6 |
| 2,868,559 | 1/1959 | Vincelette | 280/DIG. 6 |
| 3,548,905 | 12/1970 | Renshaw | 206/315.3 |
| 4,017,091 | 4/1977 | Wallen | 280/47.26 |

*Primary Examiner*—David M. Mitchell
*Attorney, Agent, or Firm*—Mason, Fenwick & Lawrence

[57] ABSTRACT

A lightweight and durable golf bag that is conventionally-shaped and is compact in its design for carrying golf clubs and accessories. The golf bag is open at the top end for insertion of golf clubs and has a shoulder strap which is used for carrying the gold bag over one's shoulder. The golf bag also has a pulling ring with a flexible strap which, when the golf bag is converted into a golf cart, is used to pull the golf bag. At the base of the bag is a rigidly constructed, T-shaped element oriented in a horizontal plane. The upper portion of the T-shaped element runs diagonally across the width of the bag, and the lower portion runs radially outward from the bag's center to its exterior. The upper portion of the T-shaped element has attached to it a metal tube into which the axles of the removable wheels can be inserted and attached. The lower portion of the T-shaped element has attached to it another metal tube into which a support stand is inserted and attached. The insertion of the wheel axle and support stand into the metal tubes located in a T-shaped element converts the golf bag into a rolling/pull cart. The removable spoked wheels with axles and metal tubing used as a support stand can be detached and stored in the side of the bag in a compartment.

7 Claims, 2 Drawing Sheets

CONVERTIBLE GOLF CART AND BAG

BACKGROUND OF THE INVENTION

1. Field of the Invention

The present invention relates to a bag for carrying and transporting golf equipment, in general, and, more specifically, to a convertible golf bag that retains its conventional shape while being used as a bag or a pull cart.

2. Prior Art

A golf bag is an item used to carry golf clubs and accessories, such as balls and tees, in playing a game of golf. Golfers can either carry the golf bag over their shoulder, place the golf bag on a riding golf cart, or place the golf bag on a separate device known as a pull cart, through which the golfer can pull the golf bag along the ground while walking around a golf course. Many golfers prefer walking to obtain appropriate exercise and, therefore, choose not to use the riding golf cart. However, when a golfer carries his clubs, the weight of the clubs and bag can often cause soreness and hurt the golfer's shoulder. Therefore, many golfers choose to use a pull cart. However, in using the pull cart, golfers often find that it is cumbersome, because, in many cases, the pull cart must be folded and unfolded, and takes additional space for storage in the car and at home.

The prior art in this field fails to provide a multi-purpose golf bag which can be easily carried over one's shoulder, attached to the back of a riding golf cart, and converted to a pull cart for transporting golf equipment on a golf course, while still maintaining the appearance of a conventional golf bag.

U.S. Pat. No. 4,836,565 (Catalo) discloses a rectangularly-shaped container for holding golf clubs which may be converted into a golf cart. The device consists of a rectangular case resembling a suitcase, a pair of detachable wheels, and a detachable handle. The wheels and the handle may be stored in pockets provided on the external side of the lower face of the suitcase or may be stored in a separate bag of small dimensions. However, this invention, due to the shape and size of the suitcase, make it ill-suited for attachment to the back of a riding golf cart and carrying over a golfer's shoulder.

U.S. Pat. No. 4,629,202 (Nelson et al) shows a combination golf cart and bag that consists of a rectangularly-shaped body, a pair of detachable wheels, and a detachable handle. The golf clubs are not easily accessible with the wheels in the storage position, and the size and shape of the golf club container have questionable utility for attaching the device to a riding golf cart and carrying over a golfer's shoulder.

U.S. Pat. No. 4,017,091 (Wallen) discloses a convertible golf cart which consists of rectangular body, a pair of detachable wheels, a resting arm, and a telescoping pull handle. However, the container's size and shape make it ill-suited for attaching the device to a riding golf cart and carrying over a golfer's shoulder.

U.S. Pat. No. 2,590,178 (Jamison) discloses the use of a convertible golf bag and cart consisting of a rectangular body, a pair of detachable wheels that can be stored therein, and a detachable handle. However, storage space required for the detachable wheels for this device dictate that it has a limited capacity to receive clubs and/or its size would be problematic for detachment to a riding golf cart or carrying over a golfer's shoulder.

Thus, the prior art appears deficient in not providing for a device that can be attached to a riding golf cart and which can be carried on one's shoulder on the golf course. Thus, there is a need for a convertible golf bag that, due to its size and structure, can be attached to a riding golf cart, and which is light enough and shaped to be carried over one's shoulder, while allowing the normal complement of clubs to be carried in the bag. The present invention is directed toward filling that need.

SUMMARY OF THE INVENTION

The present invention relates to a lightweight and durable golf bag that is conventionally-shaped and is compact in its design for carrying golf clubs and accessories. The golf bag is open at the top end for insertion of golf clubs and has a shoulder strap which is used for carrying the golf bag over a golfer's shoulder. The golf bag also has a pulling ring with a flexible strap which, when the golf bag is converted into a golf cart, is used to pull the golf bag. At the base of the bag is a rigidly constructed, T-shaped element oriented in a horizontal plane. The upper portion of the T-shaped element runs diagonally across the width of the bag, and the lower portion runs radially outward approximately from the bag's center to its exterior. The upper portion of the T-shaped element has attached to it a metal tube into which the axles of removable wheels can be inserted and attached. The lower portion of the T-shaped element has attached to it another metal tube into which a support stand is inserted and attached. The insertion of the wheel axles and support stand into the metal tubes located in a T-shaped element converts the golf bag into a rolling/pull cart. The removable spoked wheels with axles and metal tubing used as a support stand can be detached and stowed in the side of the bag in a compartment.

DETAILED DESCRIPTION OF THE PREFERRED EMBODIMENTS

Figure 1:
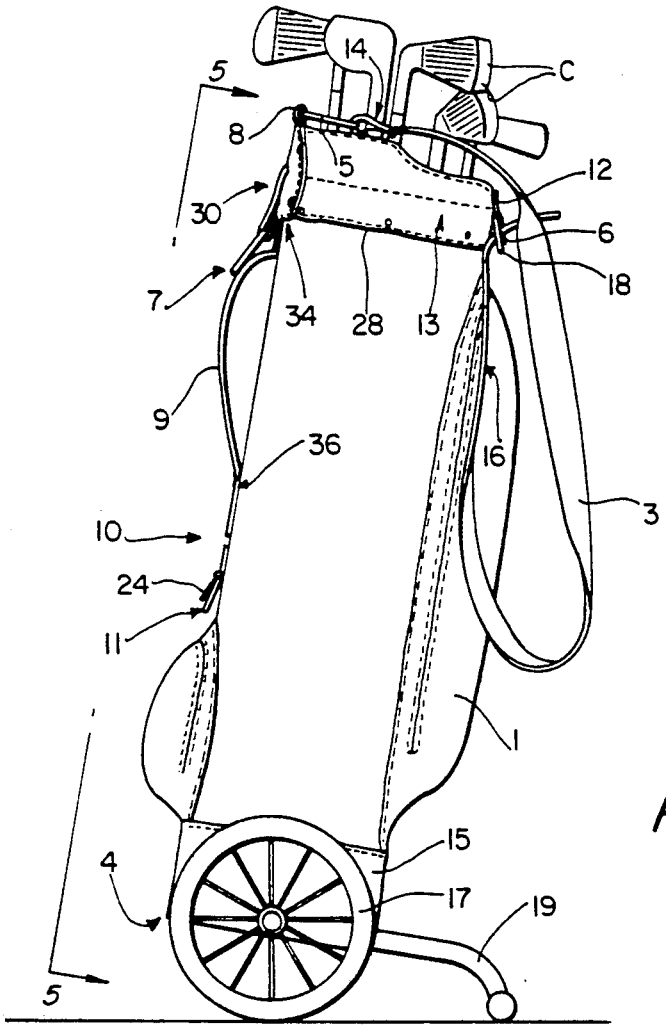
FIG. 1 is a side view of a golf bag embodying the teachings of the present invention with wheels and support stand in place.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
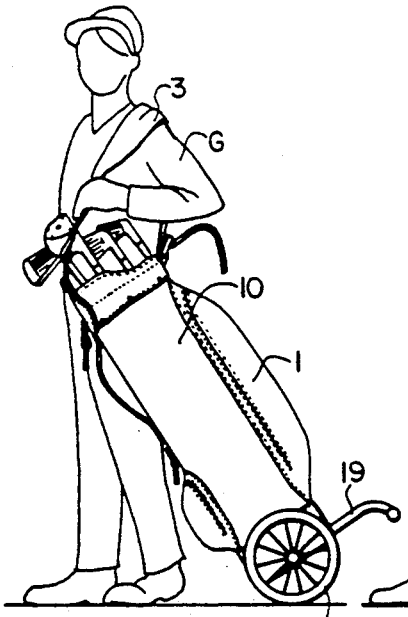
FIG. 2 is a side view of the golf bag of FIG. 1 with the wheels and stand placed onto the exterior of the golf bag whereby an individual is capable of using the bag as a pulling golf cart, with the shoulder strap placed over the individual's shoulder.
Figure 3:
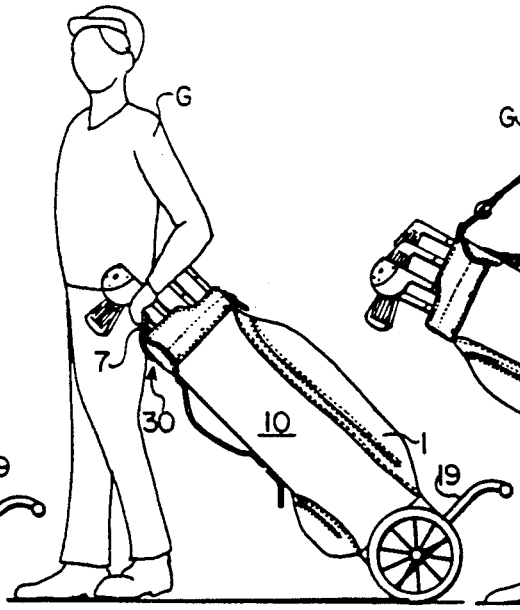
FIG. 3 is a side view of the golf bag of FIG. 1 with the wheels and support stand placed onto the exterior of the golf bag whereby an individual is capable of using the bag as a pulling golf cart, pulling the ring attached to a flexible strap attached to the side of the golf bag.
Figure 4:
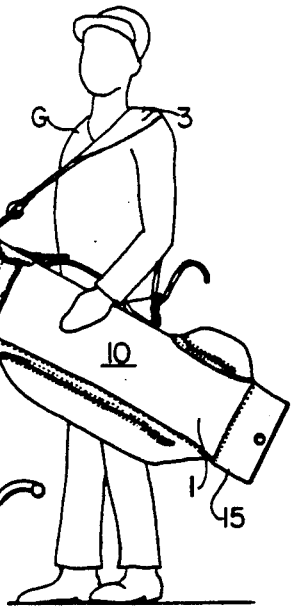
FIG. 4 is a side view of the golf bag of FIG. 1 showing an individual carrying the golf bag in a conventional format using the shoulder strap and carrying the bag over the individual's shoulder.

With reference to FIGS. 1 and 5 through 8, the present invention basically consists of a golf bag/cart, generally designated as 10, for carrying or pulling golf clubs on a golf course, in any of the positions shown in FIGS. 2, 3 and 4. Additionally, with the wheels 17 and support stand 19 stowed away, the bag may be mounted on a motorized golf cart in a conventional manner.

FIG. 1 shows the present invention fully assembled in its upright position. The body 1 of the golf bag 10 is of conventional construction and is made of a lightweight shell and covered by durable material, such as nylon, synthetic leather or other suitable materials. A large opening 2 is defined at the top of the bag where golf clubs C can be inserted. The bottom portion 4 of the bag is sealed. Attached to the body of the bag 10 are ring 5 and buckle 6. As shown in FIG. 1, the ring and buckle are positioned near the top of the bag and spaced in an opposed relationship on opposite sides of the bag 10. Ring 5 is held on the bag by folded leather strap 8, whereas pulling ring 7 is secured by a flexible strap 30. An elongated strap 3 terminating at one end in a conventional hook 14 hooked to ring 5 and the other end in a belt strap 16 that can be secured to buckle 6 by a tongue 18 as in a conventional belt. Strap 3 may be made of cloth, plastic or other suitable material with a soft substance, such as for lining disposed along the inside of the strap 3. In this configuration, strap 3 is used by a golfer G to pull the golf bag 10 as shown in FIG. 2.

On the same side of the bag 10 below the middle of the bag is a buckle 11 having a prong 24. The strap 3 can be released from the buckle 6 and prong 18 so that the belt-like portion of strap 3 may be secured to buckle 11 and prong 24 in a conventional manner. When the strap is secured in this position, then the bag 10 may be carried as a conventional bag by the golfer G as shown in FIG. 4. The strap has multiple holes to adjust the length.

At the top of the bag body 1 is a collar 13 made of leather, plastic or other suitable material which is reinforced by stitching 28 made of nylon or other suitable material. On the top front side of the golf bag near ring 5 is a pulling strap 30 terminating in a round metallic or plastic ring 7. The strap and ring are designed for pulling the golf bag by the golfer G, as shown in FIG. 3.

On the middle side of the golf bag is a handle 9 constructed of leather, plastic or other suitable material which is stitched onto the golf bag 1 by using two pieces 34 and 36; one placed at the top of the handle at the uppermost portion of the golf bag 1, and the other piece is placed at the middle of the golf bag 1 above buckle 11. This handle 9, which is in line with ring 7 and buckle 11, is used to carry the golf bag in a conventional manner.

Figure 7:
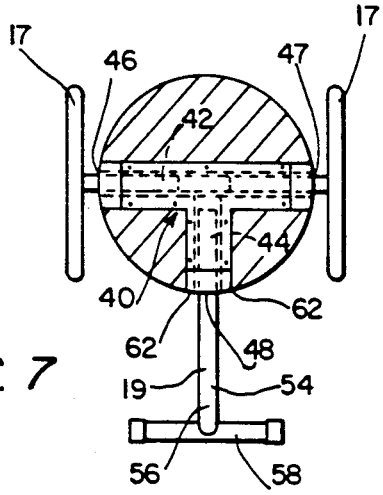
FIG. 7 is a view taken along lines 7—7 of FIG. 5.
Figure 8:
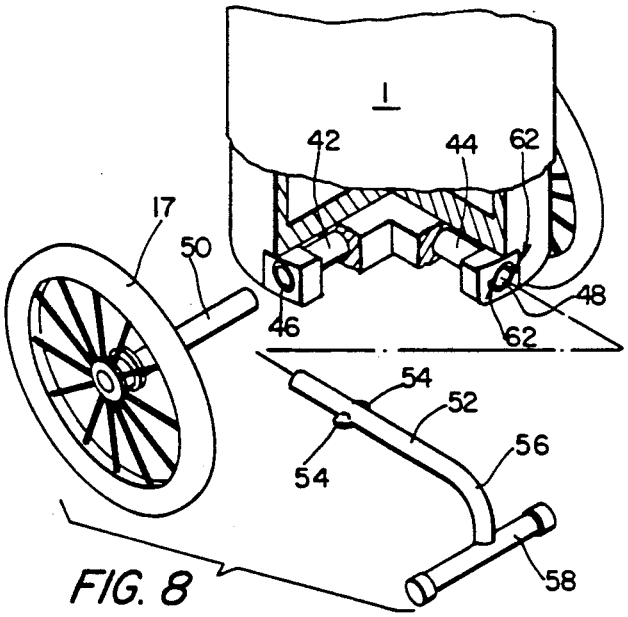
FIG. 8 is a cut-away side view of the rigidly constructed base of the inventive golf bag displaying the constructed T-shaped element placed at the base of the golf bag and showing how the wheels, or its axles, and support stand are inserted and detached from the T-shaped element.

At the bottom of the golf bag 10 is a reinforced collar 15 made of plastic or other suitable material which is stitched onto the golf bag and houses a T-shaped element 40 running diagonally across the full width of the bottom of the golf bag as shown in FIG. 7. The T-shaped element 40 is made up of a transverse hollow tube 42 that extends across the bottom of the bag essentially perpendicular to a plane defined by the longitudinal axis of the bag and rings 5, 6 and 7. A hollow tube 44 is laid perpendicular to tube 42 near the center of tube 42 which completes the T-shaped member 40. The ends 46 and 47 of tube 42 define wheel axle receiving holes, whereas end 48 of tube 44 defines a support-receiving hole.

A spoked wheel 17 terminates in a axle 50 that is shaped to slidably engage the interior of tube 42. A pair of spoked wheels is provided to support the golf bag. The axle 50 of wheel 17 is held within tube 42 by any conventional method, such as by magnetizing axle 50 or screwing axle 50 within tube 42.

The wheels are used for moving the golf bag by either pulling the shoulder strap 3, as performed by golfer G in FIG. 2 or by pulling the flexible strap 30, as performed by golfer G in FIG. 3. A support stand 19 completes the bottom of the bag when the golf bag is used as a pull cart. The stand 19 is made up of an elongated rod 52 having a pair of opposed tabs 54 that mate with slots 62 defined in end 48 of tube 44 to prevent rotation of rod 52 when it is positioned within tube 44. Rod 52 terminates on a curved portion 56 that has a transverse support leg 58.

Figure 5:
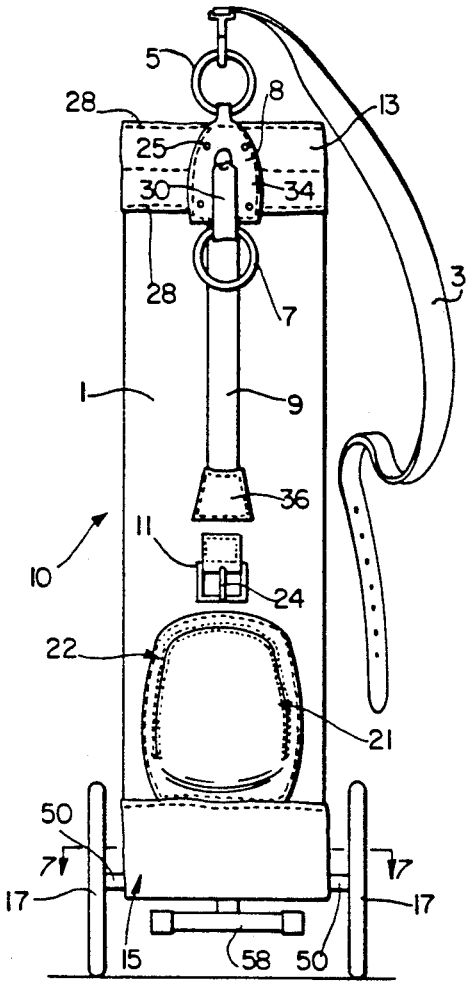
FIG. 5 is a front view of the golf bag of FIG. 1.

Referring now to FIG. 5, the golf bag 1 has attached onto it a side compartment 21 which can be fabricated from plastic cloth, leather or other suitable material. The compartment contains a zipper 22 for opening or closing the compartment to store such items as golf balls, tees and related accessories. On the other side of the golf bag 1 is an elongated storage compartment 23 which is used for storing the wheels 17 and the support stand 19 when not in use. The compartment 23 has a dual zipper 27 for opening and closing the compartment in opposite direction simultaneously for the ease of wheel storage.

The top of the flexible pulling strap 3 is reinforced into the bag by a piece 34 of leather, plastic or other suitable material similar to the collar 13 and base 15 of the bag 1 with reinforced stitching and rivets 25, which is used for pulling the golf cart as shown by G in FIG. 3.

Figure 6:
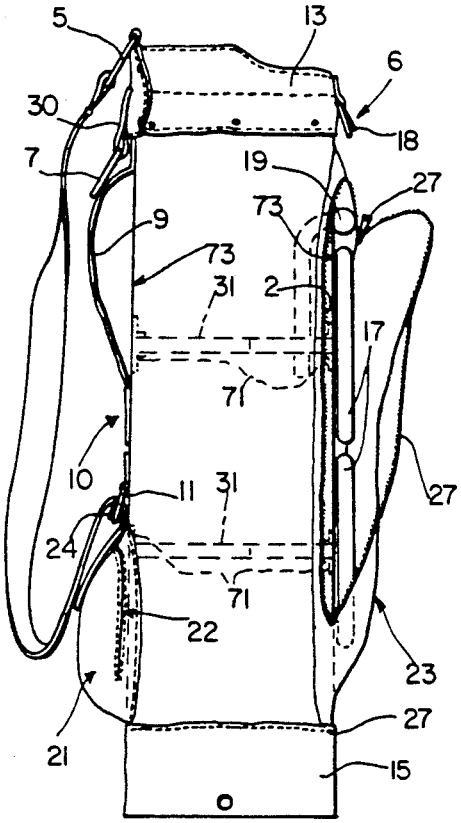
FIG. 6 shows the golf bag of FIG. 1 standing without the help of the wheels or support stand, both of which have been stowed in the provided compartment on the exterior portion of the golf bag.

Referring now to FIG. 6, inside the compartment 23 has two horizontal durable tubes 31 terminating in end caps 71 which are attached to the inner surface 73 of the compartment as by gluing to place the tubes 31 therein fixed diagonally across the golf bag body between the uppermost and lowermost portions. These tubes slidably receive the axles 50 of wheels 17 to compactly store the wheels within compartment 23.

By inserting the wheels with axles 17 and supporting stand 19 into the metal tubes located in the T-shaped element the golf bag is converted into a pull cart by simply placing the shoulder strap 3 over the shoulder of golfer G, as shown in FIG. 2, or pulling by using the pulling ring with flexible pulling strap, as shown by G in FIG. 3.

Referring now to FIGS. 2, 3 and 4, it is apparent that the present invention can be used as a pulling cart by using the shoulder strap 3 to pull the cart as shown by G in FIG. 2 or pulling the bag by using the pulling strap with ring 7 as shown by G in FIG. 3, or carrying the bag over G's shoulder as shown in FIG. 4 by using the shoulder strap 3.

From the above, it is apparent that many modifications and variations of the present invention are possible in light of the above teachings. It is therefore to be understood that, within the scope of the appended claims, the invention may be practiced otherwise than as specifically described.

What is claimed is:

1. A convertible golf bag comprising:

an elongated closed conventionally shaped golf bag body terminating at one end in a golf club receiving opening and at the other end in a bag support portion;

a plurality of first and second openings defined in said bag support portion;

a pair of axles;

a wheel rotatably mounted to each axle;

the free end of each axle mounted in said first openings to support said bag on said wheels for movement along the ground;

a first elongated strap having one end secured to the bag in the vicinity of said club receiving opening;

a ring and a first buckle mounted near the top of said bag, and a second buckle mounted on the side of said bag, said first strap being of predetermined length and securable at its one end to said ring and at its other end to said buckles in a plurality of configurations, a first configuration for pulling said bag by said wheels along the ground by a golfer with the strap being draped over the golfer's shoulder, and a second configuration for carrying said bag with the strap draped over the golfer's shoulder, said configurations involving different buckles; and a second elongated strap having one end secured to the bag in the vicinity of both said club receiving opening and said one end of said first strap, and having a second free end said second strap of sufficient length to allow the golfer to grasp the free end to pull said bag by said wheels along the ground.

2. The golf bag of claim 1, further comprising a support stand terminating in a rod-like portion for mounting within said second opening in said golf bag.

3. The golf bag of claim 2, further comprising a storage means secured to the body of said golf bag for storing said wheels and support stand.

4. The golf bag of claim 3, wherein said storage means includes a pair of spaced tubes mounted within said bag and open at one end within said storage means for slidable receiving said axle of said wheels.

5. The golf bag of claim 1, wherein said golf bag body is made of a light-weight material.

6. A convertible golf bag having detachable wheels, each wheel terminating in an elongated axle, said bag comprising:

an elongated closed conventionally shaped golf bag body terminating at one end in a golf club receiving opening and at the other end in a bag support position;

a closed storage compartment formed along a side of said golf bag between the club receiving opening and the bag support portion for storing said wheels and support stand;

zipper means for allowing said compartment to be opened to receive said wheels; and a pair of elongated tubes mounted within said bag in a spaced relationship, said tubes each being open at one end within said storage compartment for slidably receiving said axle of said wheels, the other end of each tube being mounted to an interior surface of said bag so that each of said tubes spans from the storage compartment, through an interior portion of said bag where golf clubs are stored, and to said interior surface of said bag.

7. The golf bag of claim 6, wherein said golf bag body is made of a lightweight material.

* * * * *